United States Patent [19]

Dohnomoto et al.

[11] Patent Number: 4,600,661

[45] Date of Patent: Jul. 15, 1986

[54] COMPOSITE MATERIAL WITH CARBON REINFORCING FIBERS AND MAGNESIUM ALLOY MATRIX INCLUDING ZINC

[75] Inventors: Tadashi Dohnomoto; Atsuo Tanaka, both of Toyota, Japan

[73] Assignee: Toyota Jidosha Kabushiki Kaisha, Toyota, Japan

[21] Appl. No.: 723,756

[22] Filed: Apr. 16, 1985

[30] Foreign Application Priority Data

Jun. 15, 1984 [JP] Japan ..... 59-123392

[51] Int. Cl.[4] ..... B32B 5/02; B32B 7/00

[52] U.S. Cl. ..... 428/614; 428/608; 428/610; 420/411; 420/408

[58] Field of Search ..... 428/614, 610; 420/408, 420/411

[56] References Cited

U.S. PATENT DOCUMENTS 4,465,741 8/1984 Yamatsuta et al. ..... 428/614

4,489,138 12/1984 Yamatsuta et al. ..... 428/614

FOREIGN PATENT DOCUMENTS 2033805 5/1980 United Kingdom .

*Primary Examiner*—Veronica O'Keefe

*Attorney, Agent, or Firm*—Oblon, Fisher, Spivak, McClelland & Maier

[57] ABSTRACT

This composite material includes reinforcing carbon fibers and a matrix metal which is an alloy containing from 2% to about 8% by weight of Zn, less than about 2% by weight of Zr, less than about 1% by weight of Al, and balance substantially Mg. Thereby, the strength of the composite material is found to be substantially improved. Preferably, the content of Zn in the matrix metal may be from 3% to about 7.5% by weight, even more preferably this content of Zn in the matrix metal may be from 4.5% to about 7% by weight, and optimally it may be 6% by weight. Preferably, the content of Zr in the matrix metal is less than about 0.18% by weight, and preferably the content of Al in the matrix metal is less than about 0.6% by weight. The carbon fibers may desirably be high strength carbon fibers, i.e. carbon fibers which have low graphitization level.

6 Claims, 5 Drawing Figures

COMPOSITE MATERIAL WITH CARBON REINFORCING FIBERS AND MAGNESIUM ALLOY MATRIX INCLUDING ZINC

BACKGROUND OF THE INVENTION

The present invention relates to the field of fiber reinforced materials with matrix metal being metal, and more particularly relates to such a fiber reinforced material in which the reinforcing fiber material is carbon fibers and the matrix material is a magnesium alloy.

In the field of composite materials the use of carbon fibers, either long or short, as reinforcing fibers for a matrix metal is considered to have promise as a combination, because the carbon fibers have high strength and high rigidity, while the appropriate matrix metal can have good flexibility and cracking resistance and so on; however, various problems can occur. As a matrix metal various types, especially of light metals, have been considered, and particularly aluminum and its alloys are suitable, and further magnesium and its alloys have many attractive features. In the case of a matrix which is a light metal which is not itself aluminum or is an alloy of a light metal which is not itself aluminum, such as magnesium or magnesium alloy for example, then it is common to add a certain amount of aluminum or zirconium to the light metal or alloy thereof in order to improve its properties, for example in order to ensure finer crystallization thereof and in order to improve the mechanical and thermal properties thereof; however, this added aluminum or zirconium should be restricted to be not more than a certain amount, and it is preferred to utilize aluminum rather than zirconium, on account of the relatively high price of zirconium. Now, it is a known problem that, in the process of manufacturing a composite material by compositing such a light metal or metal alloy containing aluminum in the molten state with carbon fibers, carbide producing reactions are liable to occur at the surface of the carbon fibers, by the carbon therein reacting with the aluminum content of the matrix metal, and this can in some cases severely impair the effectiveness of the carbon fibers as reinforcing material. In fact, to consider the various classes and types of carbon fibers, this impairment by carbidization of the carbon fibers is relatively light and unimportant in the case of so called high elasticity type carbon fibers which have relatively high graphitization level, but is relatively great and even is extreme in the case of so called high strength type carbon fibers which have relatively low graphitization level, so much as that these so called high strength type carbon fibers which have relatively low graphitization level are thereby made brittle and lose their strength, so as to be of almost no practical use as reinforcing fiber material for the composite material.

Now there is a per se known method of limiting this deterioration of the carbon fibers by carbidization, which is described in Japanese Patent Publication Ser. No. Sho. 49-18891 (1974): in this method, a relatively large amount of an element such as titanium or zirconium, which has a stronger tendency to form a carbide by combination with the carbon fibers than does the aluminum included in the matrix metal, is added to the matrix metal. Thus, when the carbon fibers are composited with the molten matrix metal, a layer of relatively innocuous carbide such as titanium carbide or zirconium carbide (which are more stable than aluminum carbide) is positively formed on the surfaces of the carbon fibers, so that the carbidization reaction between said carbon fibers and the aluminum contained in the matrix metal is limited. A disadvantage of this method, however, is that not only can the above described reaction not be satisfactorily restricted and controlled, but there is also the problem that the formation of a layer of brittle carbide on the surfaces of the carbon fibers causes a reduction in the strength of the resultant carbon fiber reinforced composite material, presumably because the stress propagation qualities between the carbon fibers and the matrix metal at the surfaces of the carbon fibers are impaired. Further, since such metals as titanium or zirconium are required to be used as additive metals, the cost of the process is high.

Another per se known method of limiting this deterioration of the carbon fibers by carbidization is performed by, before compositing the carbon fibers with the matrix metal containing aluminum, first forming a layer of carbide such as titanium carbide or zirconium carbide on the surfaces of the carbon fibers in a separate step. In this case, the carbide formation reaction can be satisfactorily restricted and controlled, and the layer of such carbide can be ensured to be more perfect, but a special step is required for the formation of this titanium carbide or zirconium carbide layer, which increases cost and production complexity. Further, the problem of reduction in the strength of the resultant carbon fiber reinforced composite material caused by the formation of the brittle carbide layer on the surfaces of the carbon fibers is not resolved, and this carbide layer inevitably reduces the intimacy of the contact and adhesion between the carbon fibers and the matrix metal, and thereby it becomes impossible to adequately improve the strength of the resulting composite material.

SUMMARY OF THE INVENTION

The inventors of the present application have considered various problems of the above outlined nature with regard to the production of carbon fiber reinforced materials in which the matrix metal is a light metal or metal alloy including aluminum, and in particular have considered the case in which the matrix metal is an alloy of magnesium including aluminum, in view of the desirability of the use of magnesium or an alloy thereof as a matrix metal. As a result of various experimental researches some at least of which will be detailed later, the present inventors have found that, by restricting to be not more than a certain amount the amounts of aluminum and zirconium which as mentioned above are generally added to the magnesium matrix metal or alloy of the composite material for example in order to ensure finer crystallization thereof and better mechanical and thermal properties thereof (and commercially available magnesium alloys in any case typically inevitably contain a certain amount of aluminum as an impurity), and further by adding an appropriate amount of zinc to the magnesium alloy, the deterioration of the carbon fibers is lessened and the strength of the resulting composite material is therefore increased, as compared to a conventional carbon fiber reinforced material with matrix material being magnesium alloy. Thus, it has been possible for the present inventors to obtain an inexpensively produced carbon fiber reinforced magnesium alloy composite material of good performance qualities.

Accordingly, it is the primary object of the present invention to provide a composite material including carbon fibers as reinforcing material and magnesium alloy as matrix metal, which avoids the disadvantages outlined above with respect to the prior art.

It is a further object of the present invention to provide such a composite material with carbon reinforcing fibers, which well exploits the reinforcing effects of the carbon reinforcing fibers.

It is a futher object of the present invention to provide such a composite material with carbon reinforcing fiber, which has good corrosion resistance.

It is a further object of the present invention to provide such a composite material with carbon reinforcing fibers, which has good mechanical properties.

It is a further object of the present invention to provide such a composite material with carbon reinforcing fibers, which is strong.

It is a further object of the present invention to provide such a composite material with carbon reinforcing fibers, which has high bending strength, in all the various fiber orientation directions.

It is a further object of the present invention to provide such a composite material with carbon reinforcing fibers, which has high tensile strength.

It is a further object of the present invention to provide such a composite material with carbon reinforcing fibers, which is not brittle.

It is a further object of the present invention to provide such a composite material with carbon reinforcing fibers, which has good stress propagation qualities between the carbon fibers and the magnesium alloy at the surfaces of the carbon fibers.

It is a further object of the present invention to provide such a composite material with carbon reinforcing fibers, which has good ductility.

It is a further object of the present invention to provide such a composite material with carbon reinforcing fibers, in which the deterioration of the reinforcing fibers is small or effectively zero.

It is a further object of the present invention to provide such a composite material with carbon reinforcing fibers, in the manufacture of which the carbidization reactions of the reinforcing fibers are controlled and are limited.

It is a yet further object of the present invention to provide such a composite material with carbon reinforcing fibers, which has intimate contact between the magnesium alloy matrix metal and the reinforcing carbon fibers.

It is a yet further object of the present invention to provide such a yet further object of the present invention to provide such a strength composite material with carbon reinforcing fibers, which is convenient and simple to manufacture.

It is a yet further object of the present invention to provide such a composite material with carbon reinforcing fibers, which can be manufactured at low cost.

It is a yet further object of the present invention to provide such a composite material with carbon reinforcing fibers, which does not require the use of relatively large quantities of relatively expensive zirconium.

According to the most general aspect of the present invention, these and other objects are accomplished by a composite material, comprising: (a) reinforcing carbon fibers and (b) matrix metal which is an alloy containing from 2% to about 8% by weight of Zn, less than about 2% by weight of Zr, less than about 1% by weight of Al, and balance substantially Mg.

According to such a composition, as has been found out by the experimental researches which have been performed by the present inventors as described in detail later, the strength of the composite material thus made up of carbon fibers and this sort of magnesium alloy is remarkably good. However, this strength is rather lower if the amount of zinc contained in the matrix metal is lower than about 2% by weight, and also is rather lower if the amount of zinc contained in the matrix metal is higher than about 8% by weight, and in this case the castability of the matrix metal also is decreased. Further, the strength of the composite material is even better assured if the amount of included zinc in the matrix metal is greater than about 3% by weight and is lower than about 7.5% by weight, is yet better assured if the amount of included zinc in the matrix metal is greater than about 4.5% by weight and is lower than about 7% by weight, and is best at a weight percentage of zinc of about 6%. Also, if the amount of included zirconium in the matrix metal is lower than about 0.2% by weight, then it does not have very much effect on the strength of the composite material, but if said amount of included zirconium in the matrix metal is greater than about 0.2% by weight, then the strength of the composite material decreases quite remarkably. So it is considered that said amount of included zirconium in the matrix metal should be less than about 0.2% by weight, and even more preferably should be less than about 0.18% by weight. Yet further, if the amount of included aluminum in the matrix metal is lower than about 1% by weight, then it does not have a very large effect on the strength of the composite material, although it does have some effect, but if said amount of included aluminum in the matrix metal is greater than about 1% by weight, then the strength of the composite material decreases very remarkably. So it is considered that said amount of included aluminum in the matrix metal should be less than about 1% by weight, and even more preferably should be less than about 0.6% by weight.

By thus specifying the percentage amounts by weight of zinc, zirconium, and aluminum to be included in the magnesium alloy which is used as the matrix material for the composite material, as will be understood from the results detailed later, the deterioration of the carbon fibers which they suffer during the process of infiltrating the molten matrix metal between them is small, and an inexpensive carbon fiber reinforced magnesium alloy matrix metal composite material can be obtained, without the requirement for alloying of relatively large amounts of relatively expensive zirconium, as required in some of the conventional methods detailed above.

It is hypothesized that some of the reasons that the addition of such a particular amount of zinc to the magnesium alloy which is to be used as the matrix metal for the composite material is so effective for increasing the strength of the composite material, as described above, may be as follows. Namely: (1) by the addition of zinc to it, the melting point of the magnesium alloy matrix metal is lowered, and its fluidity when molten is improved, whereby its castability is improved, so that, in the case that the carbon fiber reinforced magnesium alloy matrix metal composite material is manufactured by a pressurized casting method such as the high pressure casting method, the molten magnesium alloy matrix metal satisfactorily permeates the mass of reinforcing carbon fibers during this casting process; (2) because of the formation of crystallates of magnesium and of zinc at the surfaces of the reinforcing carbon fibers, the compatability of the carbon fibers and the magnesium alloy matrix metal is improved, so that the ductility of the carbon fiber reinforced magnesium alloy matrix metal composite material is improved; and (3) the strength of the matrix metal itself is improved. Additionally, according to the composition of the magnesium alloy matrix metal for the composite material of the present invention, since as mentioned above the castability of the magnesium alloy matrix metal is improved, the efficiency of the pressurized casting method for making the carbon fiber reinforced magnesium alloy matrix metal composite material is improved, and also by the addition of zinc the corrosion resistance of the matrix metal is, if only slightly, improved.

Now, with regard to the amount of impurity which is to be considered as acceptable in the magnesium alloy matrix metal, it is in practice always the case that commercially available magnesium alloys contain certain amounts of impurities such as Fe, Si, and Mn. As will be seen from the experimental results to be detailed later, it is considered to be acceptable, for the composite material of the present invention, if the total weight percentage of such impurities in the magnesium alloy matrix metal should be not more than about 0.5%.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and spaces and so on are denoted by like reference symbols in the various figures thereof; in the description, spatial terms are to be everywhere understood in terms of the relevant figure; and:

DESCRIPTION OF THE PREFERRED EMBODIMENTS

The present invention will now be described with reference to the preferred embodiments thereof, and with reference to the appended drawings. In order to determine the effects on the physical characteristics of composite material including carbon fibers as reinforcing material of the quantities of included zinc, zirconium, and aluminum in the magnesium alloy matrix metal used for said composite material, certain magnesium alloys detailed hereinafter were manufactured, composite material samples were manufactured from said magnesium alloys as explained hereinafter, and then certain tests as also detailed hereinafter were performed on said composite material samples.

First eighteen samples of magnesium alloy were made with compositions substantially as shown in the Table, which is given at the end of this specification and before the claims thereof, by adding various amounts of zinc, zirconium, and aluminum to magnesium of nominal purity 99.9%, by then melting each alloy sample at a temperature of about 700° C., by then degasifying it, and by then smelting it using flux of type No. 310, made by Dow Chemical KK. For the alloys detailed in the Table, the remainder of the alloy in each case was Mg, and the units are weight percentages.

Next, in the case of each of these magnesium alloys, a composite material sample was manufactured as follows.

Figure 4:
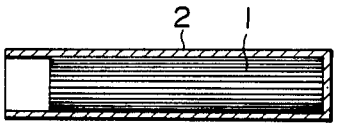
FIG. 4 is a sectional view of a stainless steel case with a bundle of long carbon fibers received in it, as prepared during a preliminary stage of manufacture of an exemplary one of said composite material samples.

First, a number of skeins of long carbon fibers were bundled together into a fiber bundle with substantially all the carbon fibers aligned along the same direction: the carbon fibers were of type "Toreka T300" (this is a trademark) made by Tore KK, and were of average fiber diameter about 7 microns and average fiber length about 100 mm, and each skein of the carbon fibers contained about 6000 individual carbon fibers. These carbon fibers are high strength type carbon fibers which have relatively low graphitization level, of the sort discussed in the part of this specification entitled "Background of the Invention". The resulting carbon fiber bundle had length about 100 mm, width about 18 mm, and height about 8 mm, and the carbon fibers were all aligned along the longitudinal direction thereof. Then, as shown in FIG. 4 which is a sectional view, the carbon fiber bundle was inserted into a stainless steel case 2, which had one open end and one closed end, and was of length about 120 mm, width about 20 mm, and height about 10 mm, with the carbon fibers (denoted by the reference numeral 1) all aligned along the longitudinal direction of the case 2. This case 2 was made of stainless steel of type JIS (Japanese Industrial Standard) SUS304.

Figure 5:
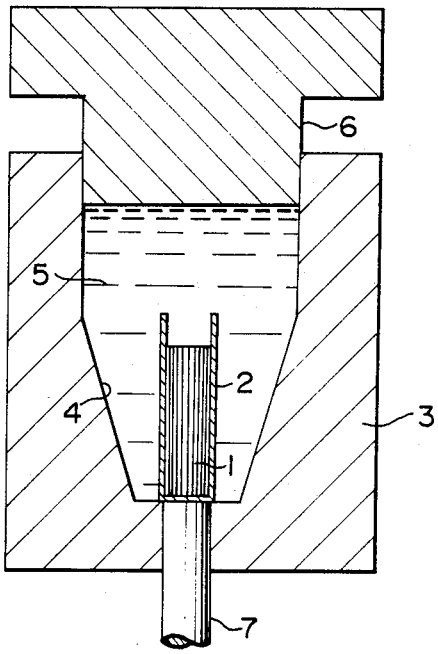
FIG. 5 is a sectional view of a high pressure casting device with said stainless steel case and said carbon fibers received in a mold cavity thereof, during said manufacture of said exemplary one of said composite material samples.

Next, this case 2 and the carbon fibers 1 held therein were preheated to a temperature of about 700° C., and were placed into a mold cavity 4 of a casting mold 3 of a high pressure casting device, as shown in cross sectional view in FIG. 5, with the open end of the stainless steel case 2 facing upwards. At this time, the casting mold 3 itself was preheated to a temperature of about 200° C. Next, a quantity 5 of the particular magnesium alloy from the Table which was being used, molten and at a temperature of about 700° C., was poured into the mold cavity 4 around the case 2 and the carbon fibers 1, and then a pressure plunger 6, itself preheated up to a temperature of about 200° C., was fitted into the top portion of the mold cavity 4 and was pressed downwards against the free surface of the molten magnesium alloy mass 5, so as to compress it to a pressure of about 1500 kg/cm$^2$; and this pressure was maintained while the apparatus cooled, until the molten magnesium alloy mass 5 had completely solidified. During this cooling process, the molten magnesium alloy entered into the inside of the case 2, and permeated the bundle long carbon fibers 1, so as to become intimately commingled therewith. After the complete solidification of the molten magnesium alloy mass 5, the plunger 6 was removed, and the solidified cast mass in the mold cavity 4 was removed therefrom by the use of a knock out pin 7. Machining operations were then performed on this solidified cast mass, to remove the magnesium alloy mass surrounding the stainless steel case 2, and then to remove said stainless steel case 2 itself, so that there was isolated a mass of composite material with carbon reinforcing fibers and magnesium alloy matrix metal. Then, a bending strength test sample piece was machined from this composite material, of length about 100 mm, width about 10 mm, and thickness about 2 mm, and with the carbon fibers included therein aligned along its longitudinal direction.

Each of these eighteen bending strength test sample pieces, as cut from the eighteen samples of composite material manufactured as described above using as matrix metal the eighteen different magnesium alloy detailed in the Table, was then subjected to a three point bending strength test in the fiber orientation 0° direction, with the distance between the supports being 80 mm. In these bending strength tests, the surface stress M/Z at the instant of fracture (where M is the bending moment at the instant of fracture and Z is the cross sectional coefficient of the bending strength test sample) was measured as the bending strength of the test sample of carbon fiber reinforced magnesium alloy matrix metal composite material. The results of these bending strength tests are shown in FIGS. 1 to 3, which relate respectively to the effect of zinc content, zirconium content, and aluminum content on the bending strength of the composite material samples; and the identifying numerals on each of these graphs for the various data points thereof refer to the numbers, as shown in the Table, of the magnesium alloys used as matrix material for said samples.

Figure 1:
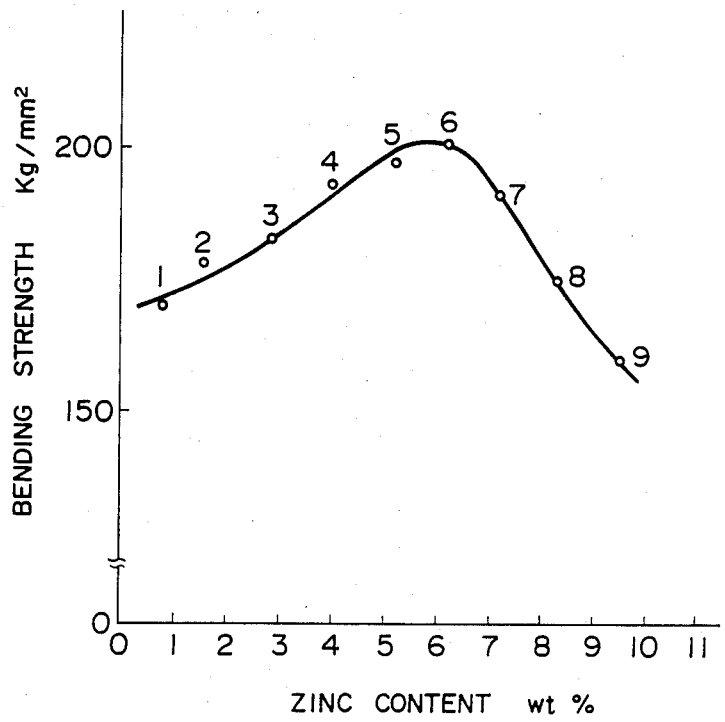
FIG. 1 is a graph in which zinc content of the magnesium alloy matrix metal of various composite material samples (some of which are samples of embodiments of the present invention and some of which are comparison samples) which have carbon fibers as reinforcing material and various magnesium alloys as said matrix metal, as a weight percentage, is shown along the horizontal axis and bending strength of said composite material samples in $kg/mm^2$ is shown along the vertical axis.

In detail, FIG. 1 is a graph in which the zinc content of the matrix metal of the composite material samples 1 through 9 of the Table (some of which are samples of embodiments of the present invention and some of which are comparison samples), as a weight percentage, is shown along the horizontal axis, and the bending strength of said composite material samples 1 through 9 kg/mm$^2$ is shown along the vertical axis. This shows that the composite material samples are considerable stronger with regard to bending strength, when the zinc content of the matrix metal thereof rises to be above 2% by weight, and further it is seen that the bending strength of the composite material samples continues to rise as the zinc content continues to rise, up to a zinc content of approximately 6% by weight, after which said bending strength starts to fall sharply, and reverts to that of a sample which contains substantially no zinc, when the zinc content comes to be above 8% by weight or so. Accordingly, from this graph, it is determined, in order to provide good bending strength, that the limits for the zinc content of the magnesium alloy matrix metal for the composite material according to the present invention, should be that said zinc content should be greater than or equal to about 2% by weight, and should be less than or equal to about 8% by weight. Further, it is considered to be even more desirable that said zinc content of the magnesium alloy matrix metal for the composite material according to the present invention should be greater than or equal to about 3% by weight, and should be less than or equal to about 7.5% by weight, and to be yet more desirable that said zinc content should be greater than or equal to about 4.5% by weight, and should be less than or equal to about 7% by weight. And it is considered to be optimal for said zinc content to be about 6% by weight.

Figure 2:
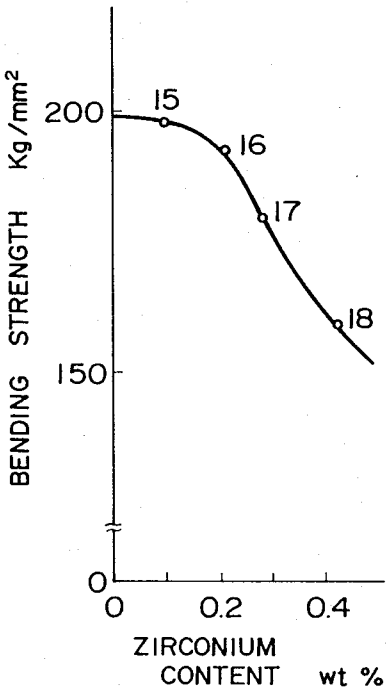
FIG. 2 is a graph in which zirconium content as a weight percentage of the magnesium alloy matrix metal of various other such composite material samples is shown along the horizontal axis and bending strength of said composite material samples in $kg/mm^2$ is shown along the vertical axis.

Further, FIG. 2 is a graph in which the zirconium content of the matrix metal of the composite material samples 15 through 18 of the Table (again some of which are samples of embodiments of the present invention and some of which are comparison samples), as a weight percentage, is shown along the horizontal axis, and the bending strength of said composite material samples 15 through 18 in kg/mm$^2$ is shown along the vertical axis. This shows that the composite material samples are considerable stronger with regard to bending strength, when the zirconium content of the matrix metal thereof is below approximately 0.18% by weight, after which said bending strength starts to fall, and that, after the zirconium content of said composite material samples reaches approximately 0.2% by weight, said bending strength starts to fall even more sharply. Accordingly, from this graph, it is determined, in order to provide good bending strength, that the limit for the zirconium content of the magnesium alloy matrix metal for the composite material according to the present invention should be that said zirconium content should be less than or equal to about 0.2% by weight; and, further, it is considered to be even more desirable that said zirconium content of the magnesium alloy matrix metal for the composite material according to the present invention should be less than or equal to about 0.18% by weight. And it is considered to be optimal for said zirconium content to be as low as practicable.

Figure 3:
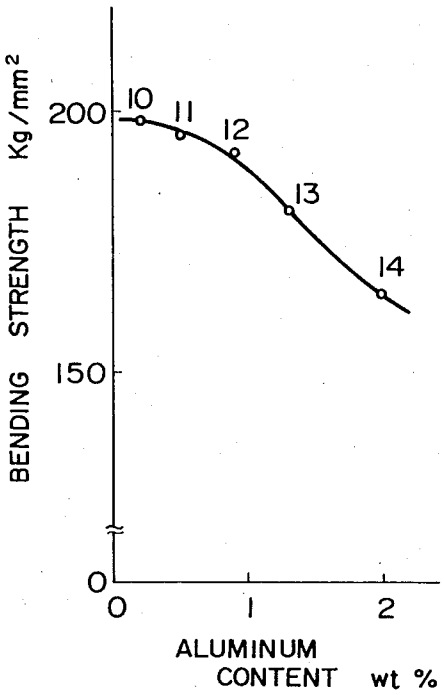
FIG. 3 is a graph in which aluminum content as a weight percentage of the magnesium alloy matrix metal of various other such composite material samples is shown along the horizontal axis and bending strength of said composite material samples in $kg/mm^2$ is shown along the vertical axis.

Further, FIG. 3 is a graph in which the aluminum content of the matrix metal of the composite material samples 10 through 14 of the Table (again some of which are samples of embodiments of the present invention and some of which are comparison samples), as a weight percentage, is shown along the horizontal axis, and the bending strength of said composite material samples 10 through 14 in kg/mm$^2$ is shown along the vertical axis. This shows that the composite material samples are considerable stronger with regard to bending strength, when the aluminum content of the matrix metal thereof is below approximately 0.6% by weight, after which said bending strength starts to fall, and that, after the aluminum content of said composite material samples reaches approximately 1% by weight, said bending strength starts to fall even more sharply. Accordingly, from this graph, it is determined, in order to provide good bending strength, that the limit for the aluminum content of the magnesium alloy matrix metal for the composite material according to the present invention should be that said aluminum content should be less than or equal to about 1% by weight; and, further, it is considered to be even more desirable that said aluminum content of the magnesium alloy matrix metal for the composite material according to the present invention should be less than or equal to about 0.6% by weight. And it is considered to be optimal for said aluminum content to be as low as practicable.

Further, EPMA and ESCA analyses were carried out on the ones of these carbon fiber reinforced magnesium alloy matrix metal composite material which were embodiments of the present invention. The results of these analyses will not be particularly detailed herein in the interests of brevity of description; however, as a result of these measurements, it was inferred that there was almost no deterioration of the carbon fibers due to the generation of carbides at the surfaces of the carbon fibers. It was also inferred that crystallates of magnesium and zinc had formed and had improved the propagation of stress between the carbon fibers and the magnesium alloy matrix metal, and it was considered that these crystallates had had the effect of improving the ductility of the carbon fiber reinforced magnesium alloy matrix metal composite material.

Further, tests relating to bending strength in the fiber orientation 90° direction, and other tests relating to tensile strength, were carried out on the various carbon fiber reinforced magnesium alloy matrix metal composite materials. The results of these analyses will not be particularly detailed herein in the interests of brevity of description; however, as a result of these measurements, it was confirmed that the ones of those carbon fiber reinforced magnesium alloy matrix metal composite materials which were embodiments of the present invention had higher bending strength in the fiber orientation 90° direction, and has also higher tensile strength, than do conventional carbon fiber reinforced magnesium alloy matrix metal composite materials manufactured according to conventional methods, as described in the parts of ths specification relating to the prior art.

Although the present invention has been shown and described with reference to the preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

TABLE

| Alloy No. | Zn | Al | Zr | Impurities |
|---|---|---|---|---|
| 1 | 0.8 | 0.1 | approx. 0.01 | approx. 0.5 |
| 2 | 1.6 | 0.1 | approx. 0.01 | approx. 0.5 |
| 3 | 2.9 | 0.12 | approx. 0.01 | approx. 0.5 |
| 4 | 4.0 | 0.08 | approx. 0.01 | approx. 0.5 |
| 5 | 5.2 | 0.15 | approx. 0.01 | approx. 0.5 |
| 6 | 6.3 | 0.16 | approx. 0.01 | approx. 0.5 |
| 7 | 7.2 | 0.23 | approx. 0.01 | approx. 0.5 |
| 8 | 8.3 | 0.18 | approx. 0.01 | approx. 0.5 |
| 9 | 9.5 | 0.21 | approx. 0.01 | approx. 0.5 |
| 10 | 5.8 | 0.2 | approx. 0.01 | approx. 0.5 |
| 11 | 6.0 | 0.5 | approx. 0.01 | approx. 0.5 |
| 12 | 5.7 | 0.9 | approx. 0.01 | approx. 0.5 |
| 13 | 5.9 | 1.3 | approx. 0.01 | approx. 0.5 |
| 14 | 5.9 | 2.0 | approx. 0.01 | approx. 0.5 |
| 15 | 5.7 | 0.11 | 0.1 | approx. 0.5 |
| 16 | 5.6 | 0.18 | 0.21 | approx. 0.5 |
| 17 | 5.7 | 0.15 | 0.28 | approx. 0.5 |
| 18 | 6.0 | 0.2 | 0.42 | approx. 0.5 |

What is claimed is:

1. A composite material consisting essentially of:

(a) reinforcing carbon fibers; and (b) a matrix metal which is an alloy containing from 2% to about 8% by weight of Zn, less than about 2% by weight of Zr, less than about 1% by weight of Al, with the balance being substantially Mg.

2. The composite material according to claim 1, wherein the content of Zn in said matrix metal is from 3% to about 7.5% by weight.

3. The composite material according to claim 1, wherein the content of Zn in said matrix metal is from 4.5% to about 7% by weight.

4. The composite material according to claim 1, wherein the content of Zn in said matrix metal is about 6% by weight.

5. A composite material according to claim 1, wherein the content of Zr in said matrix metal is less than about 0.18% by weight.

6. A composite material according to claim 1, wherein the content of Al in said matrix metal is less than about 0.6% by weight.

* * * * *